United States Patent [19]

Goserud

[11] 4,380,208

[45] Apr. 19, 1983

[54] PORTABLE SEAT

[76] Inventor: Dean L. Goserud, 1981 Princeton Ave., St. Paul, Minn. 55105

[21] Appl. No.: 281,233

[22] Filed: Jul. 6, 1981

[51] Int. Cl.[3] ..... B63B 17/00

[52] U.S. Cl. ..... 114/363; 114/347; 114/364; 5/122; 297/217

[58] Field of Search ..... 114/363, 347, 364; 5/120, 122, 123, 127, 98 B; 297/281, 282, 217, 45, 441

[56] References Cited

U.S. PATENT DOCUMENTS

| | | | |
|---|---|---|---|
| 116,934 | 7/1871 | Cutter . | |
| 328,474 | 10/1885 | Fletcher | 5/127 |
| 400,131 | 3/1889 | Small | 5/122 |
| 602,125 | 4/1898 | Burrows | 297/217 |
| 1,071,954 | 9/1913 | Pietilainen | 5/122 |
| 1,372,528 | 3/1921 | Marcovsky | 114/363 |
| 2,299,178 | 10/1942 | Reiter | 114/363 |
| 2,815,517 | 12/1957 | Andresen, Jr. . | |
| 3,159,854 | 12/1964 | Covacevich . | |
| 3,328,811 | 7/1967 | Norton . | |

OTHER PUBLICATIONS

Coleman Brochure No. 5900-775 showing portable "Passenger Seat for Coleman Canoes and Scanoes TM", (1 page printed front and back).

L. L. Bean Catalog p. 109 showing a portable "Snowshoe Canoe Seat" (from catalog of indeterminate date but prior to applicant's invention).

Eddie Bauer Catalog p. 37 showing "Hav-A-Seat" portable seat for "boat or stadium", (page printed on both sides).

Garelick Mfg. Co. 1981 catalog cover page and p. 8 thereof showing a "Beach Utility Chair" which Makes good extra seating in canoes.

P. 198 from L. C. Bean's Spring Catalog for 1981 which shows "Bean's Canoe Chair".

*Primary Examiner*—Trygve M. Blix
*Assistant Examiner*—D. W. Keen

[57] ABSTRACT

A portable seat for suspension between spaced supports is provided comprising a flexible seating member having rigid side edge members and rigid suspension members spaced outwardly from and generally parallel thereto, the suspension members and the rigid side edge members having securing means adjacent the ends thereof, each side edge member being adjustably secured to its associated suspension member by a length of rope slidably threaded through the securing means so that the spacing between the side edge members and the suspension members can be adjusted by varying the effective rope length, which effective length is maintained by preventing movement of the rope back through the securing means after the desired distance between side edge members and suspension means is achieved. For sway prevention each rope length may be threaded through the securing means to provide both parallel legs and diagonally crossed legs. By having the ends of each rope extend through a common securing means ease of adjustment is facilitated.

14 Claims, 9 Drawing Figures

PORTABLE SEAT

This invention relates to a portable seat for suspension between spaced supports and more particularly relates to a portable seat which is provided with a simple easily operable adjusting means to facilitate suspension of the seat between supports relatively independently of the distance between supports and which seat is collapsible when not in use to an extremely small size for storage and transport.

While developed particularly to provide a portable seat for passenger seating in canoes and similar kinds of small watercraft to accommodate beams of different widths, the seat has more general uses in that it can be mounted for suspension between any spaced supports on land or water. Further, the seat is collapsible from its in use position to its storage and transport condition and vice versa with no disassembly whatsoever and without the necessity for any hinged or jointed connections.

Most canoes are provided with seats for the paddlers at the front and back ends thereof but are quite often without seats for any passengers as the rest of the space in the hull is kept free of obstacles for cargo to be carried in the canoe and for ease of portage. Of course, there are larger canoes with permanently mounted seats therein and there have been long available portable seats for canoe passengers which simply rest on the floor of the canoe shell. Such temporary seats come in a wide variety of constructions ranging from simple lightweight short-legged deck chairs which can be folded or disassembled to elaborate foldable wooden chairs. None of these seats approaches the simplicity and versatility of the portable seats I have invented.

My new portable seat for suspension between spaced supporting means comprises a seating member and suspension means interconnected to one another by flexible elements, e.g., high strength ropes, cords, or the like, in a manner to readily vary the spacing between the suspension means and the seating member to accommodate the seat for suspension between spaced supporting means varying distances apart. The seating member is provided with elongated rigid side edge portions having flexible element securing means adjacent the ends thereof. The suspension means may comprise elongated rigid members generally parallel to the seating member side edge portions which also have flexible element securing means carried thereby spaced approximately the same distance from one another as are the securing means of the rigid side edge portions of the seating member. These suspension members are also provided with means for hooking them over the supports in suspending the seat therebetween.

Alternately, the suspension means may comprise simple hooking or other attaching elements which are provided with flexible element securing means thereon and which are constructed to clamp onto or otherwise attach to supports between which the seat is to be suspended, the suspension means at each side of the seat having the securing means thereof attached to the supports approximately the same distance apart as are the securing means on each seating member side edge portion.

The flexible elements are slidably carried in the securing means of the seating member side edge portions and those of the suspension means and hold the seating member in suspension there between. Adjusting means are provided to adjust the lengths of said flexible elements and thereby fix the maximum distance between the side edge portions of the seating member and the suspension means for proper centering of the seating member between the supports from which the seat is suspended.

This adjustable portable suspension seat is not only extremely simple in construction and self-evident in its manner of use but it is readily collapsed into a rolled up state resembling and approximately the size of a small bundle of tent pegs in which condition it can be stored and transported in a knapsack. The seat can be made ready for suspension between the gunwales of a small, medium or large beamed canoe or between any other suitably spaced supports simply by unrolling the seat from its collapsed condition with no further ado. I know of no similar seat assembly.

A preferred form of my new portable suspension seat is illustrated in the accompanying drawings wherein.

Figure 1:
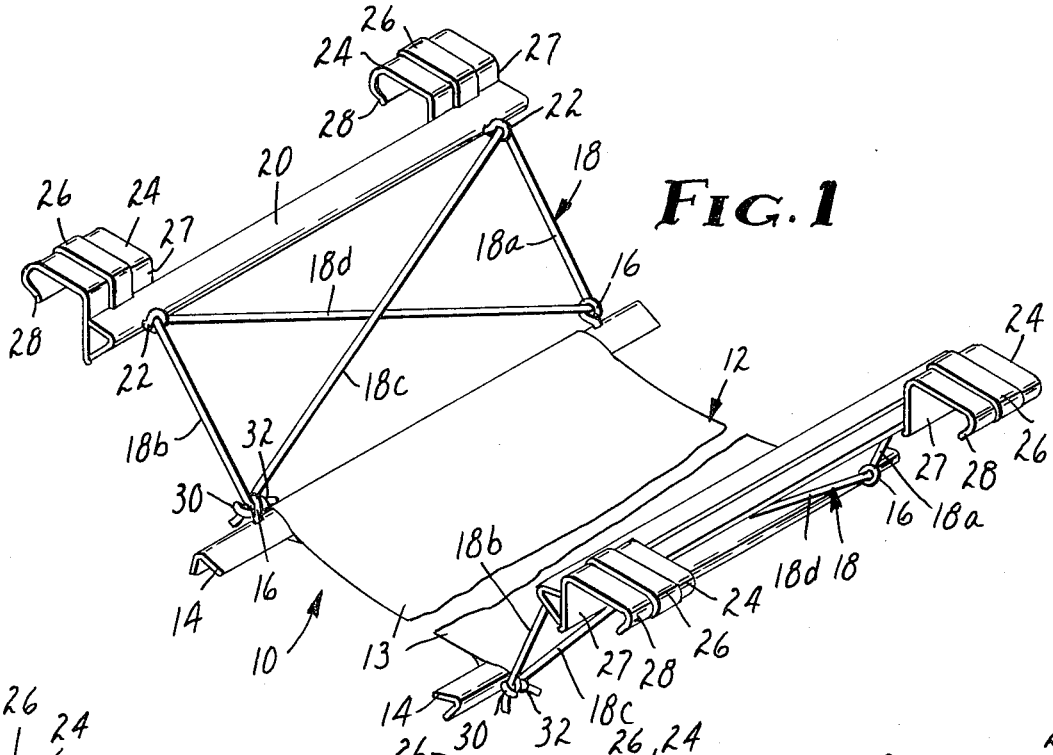
FIG. 1 is a perspective view of the seat.

Turning now to a description of the accompanying drawings in more detail, in FIG. 1 the portable seat shown therein as being a preferred embodiment of my invention is designated in its entirety by the numeral 10 and is seen to comprise a seating member 12 having a seating portion 13 in the form of a flexible rectangular sheet of tough flexible material, e.g., cloth or fabric such as canvas or other tough synthetic or natural material or combination thereof. The side edges of the seating portion 13 are formed into tubes through which the rigid side edge portions 14 of the seating member 12 extend. The rigid side edge portions 14 are shown as rigid elongated members in the form of high strength metal; they may be of any other suitable construction. Indeed, the seating member may be a self-sustaining slab where compactness on collapsing is not required.

Adjacent the ends of the rigid side edge portions 14 securing means 16 are attached in the form of eyelets for slidably receiving flexible elements 18, which are ropes or cords. A preferred flexible element 18 is a high-strength braided rope of olefin fibers such as polypropylene as such rope is extremely strong and relatively impenetrable to water in which knots may be easily tied and untied by virtue of the rope's slippery surface.

Rigid suspension members 20 are generally parallel to and spaced from the side edge portions 14 of the seating member 12 and have securing means 22 thereon generally opposite the securing means 16 on the seating member side edge portions 14. The suspension members 20 are shown as being of the same construction as the rigid members forming side edge portions 14 of the seating member 12. The hooking elements 24 attached thereto can be of any desired shape or configuration so long as they can be hooked over the gunwales of a canoe or other similar supports. Each of the hooking elements 24 illustrated is of flat metal sheet stock having a central strengthening rib 26 formed therein throughout its length and bent to U-shape to provide a bight portion 25 and depending inner and outer legs 27 and 28 respectively. The outer leg 28 is bent inwardly back toward inner leg 27 and at its free end is bent outwardly to provide a lip 29 to prevent damage to the support surface. Of course, the inner surfaces of hooking elements may be coated with rubber or soft plastic or similar material to further protect the support surfaces from abrasion when the seat 10 is attached thereto.

Securing means 16 and 22 which slidably carry the ropes 18 which interconnect or attach members 14 and 20 to one another are each illustrated as eyelets carried by members 14 and 20. These securing means could each simply comprise closely spaced holes provided in members 14 and 20 for the rope 18 to be threaded through or any other means which permits the ropes 18 to slidably interconnect the members 14 and 20 to one another at each side of the seat member 12.

In the embodiment shown, each length of rope 18 interconnecting each side of the seating member 12 to its associated suspension member 20 is threaded through securing means 18 and 22 to provide parallel legs **18*a* and 18*b* interconnecting the securing means 16 and 22 at the front end of the seat 10 and the securing means 16 and 22 at the back end of the seat with diagonal legs 18*c* and 18*d* bridging the gap between the two parallel legs. This truss-like arrangement of the flexible element 18 on each side of the seat assembly maintains the seat member in a relatively firm non-swaying position when the seat is suspended between a pair of spaced supports. Without the diagonally crossed legs 18*c* and 18*d* of each flexible element 18, the seat member 12 tends to sway considerably and is much less satisfactory. The end portions of the rope 18 at each side of the seat 10 are passed through the same securing means, whether it be one of the securing means 16 or 22 and are knotted at each end so they cannot pass back through the securing means through which the end portions pass. The knots are designated by numerals 30 and 32, respectively. These knots comprise means for adjustably interengaging the flexible elements and at least one of the securing means carried by the rigid portions 14 or members 20 at each side of the seat 10 to adjust the length of the ropes. By thus abutting the securing means, placement of the knots adjust the maximum distance between the seating member side edge portions 14 and the suspension members 20 when suspending the seat 10 between supports. The ease of this adjustment is clearly illustrated in FIGS. 2 and 3**.

Figure 2:
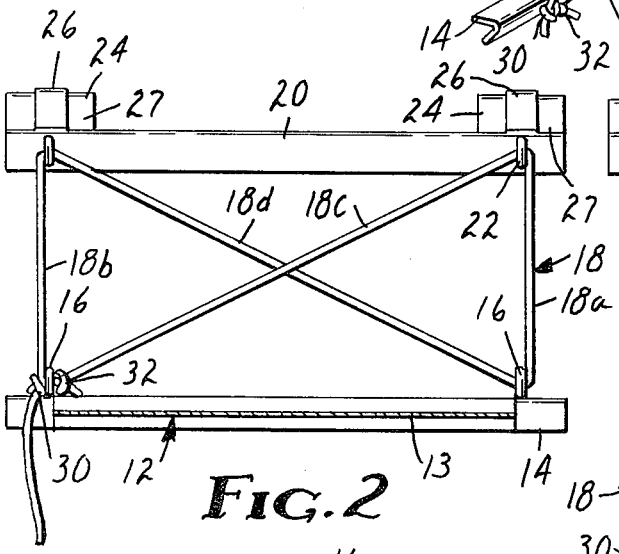
FIG. 2 is a side view similar to that of FIG. 2 showing the seat adjusted for use between widely spaced supports.
Figure 3:
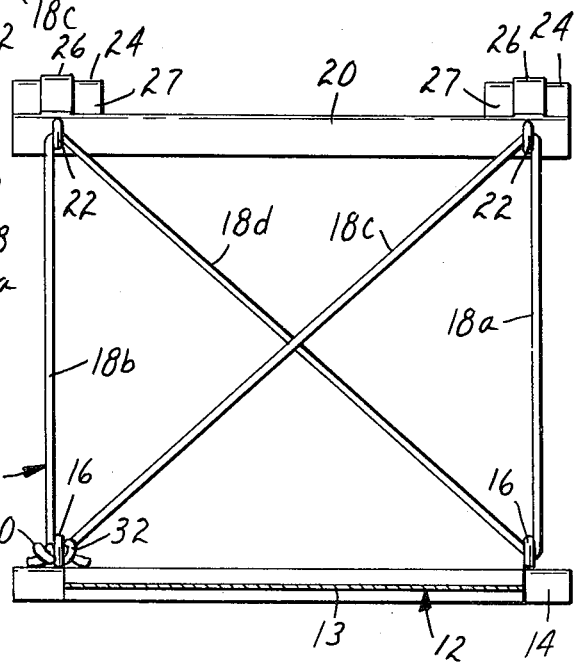
FIG. 3 is a side view of a portion of the seat showing the seat adjusted for suspension between closely spaced supports.

As shown in FIG. 2, knots 30 and 32 are provided at the extreme end portions of the rope 18 for maximum spacing of each seat member side edge portion 14 from its associated suspension member 20 for mounting the seat 10 between widely spaced supports. By unknotting knot 32 at the outer end of the rope and pulling that end of the rope 18 through the securing means 16 while not disturbing knot 30, and forming new knot 32 further from the rope end, the length of rope 18 is shortened and members 14 and 20 are moved closer together whereby the maximum distance between them is decreased as shown in FIG. 3 to mount the assembly between more closely spaced supports.

While knots 30 and 32 are shown in the preferred embodiment as the adjustable means interengaging the flexible elements with each rigid side edge portion of the seating member 12, obviously other means could be used to fix the length of the rope 18. For example, a cleat on the boat could be utilized to secure both end portions of the rope and either end of the flexible element 18 could be used as the fixed end, and it would be unnecessary to make knots of any sort and no interengagement of adjustable means with the seat 10 need take place at all. However, the simplicity of knotting the rope 18 to do the job is preferred as this system makes a completely adjustable portable seat independently of extrinsic aids.

Figure 4:
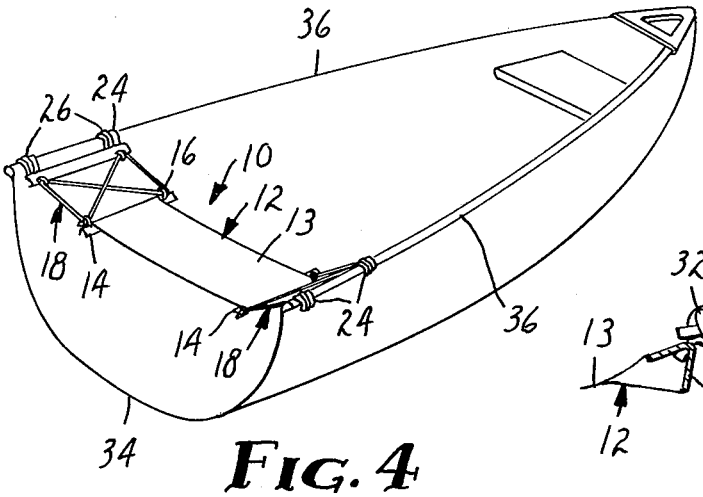
FIG. 4 shows the seat suspended between the gunwales of a canoe.

In FIG. 4 the seat 10 is shown mounted on a canoe 34 by suspension between the gunwales 36.

Figure 5:
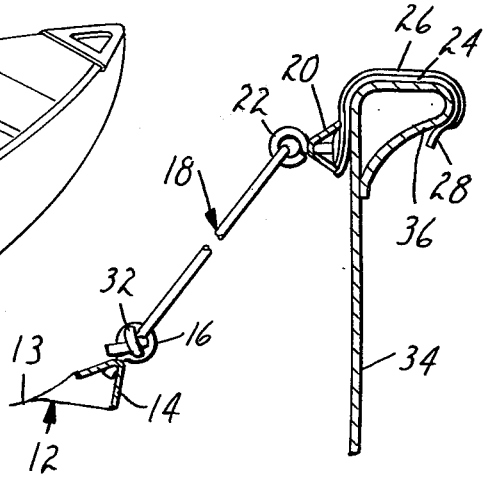
FIG. 5 is a cross sectional view of the attachment of the seat to the canoe gunwales.

In FIG. 5 the positioning of the hook elements 24 over the gunwale 36 is readily apparent.

Figure 6:
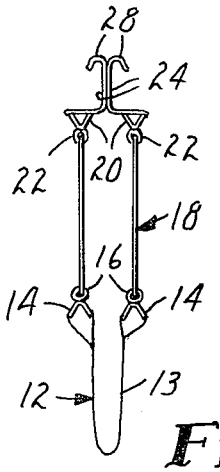
FIG. 6 shows an end view of the seat in a partially collapsed state.
Figure 7:
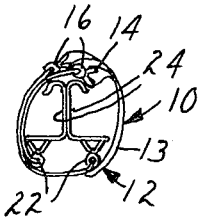
FIG. 7 is an end view of the seat rolled up in its completely collapsed condition.

FIGS. 6 and 7 illustrate the way in which the seat 10 may be conveniently collapsed. As shown in FIG. 6, the hook elements 24 of the suspension members 20 are brought together so that the ropes 18 hang straight down and the flexible seat portion 13, as its side edges depend from the rigid side edge members 14 of seating member 12, sags to a U-shape. From this position the flexible portions of the seat 10 may be simply wrapped around the suspension members 20 to form a scroll-like roll around these members with members 14 and 20 being adjacent one another like bundled tent pegs as shown in FIG. 7 to completely collapse the seat assembly 10 for storage and transport.

Figure 8:
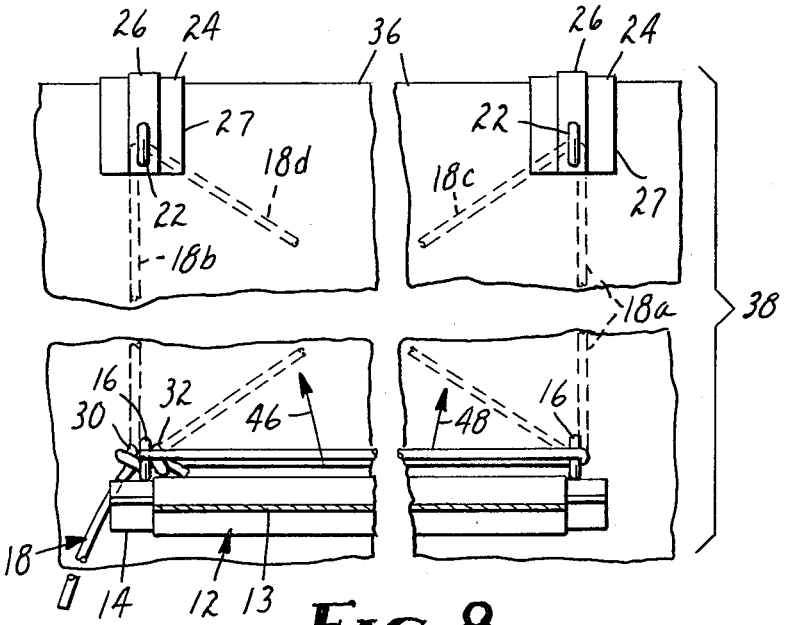
FIG. 8 is a cross sectional side view of a modified seat.
Figure 9:
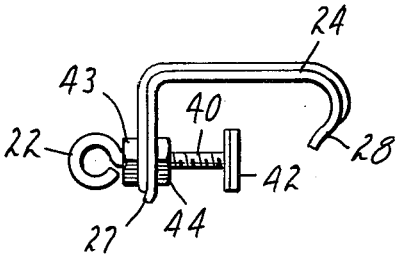
FIG. 9 is a side view of the modified seat of FIG. 8 showing its manner of attachment to the canoe gunwales.

In FIGS. 8 and 9 a modified seat 38 is shown suspended between the gunwales 36 of canoe 34. This seat comprises seating member 12 having seat portion 13 and rigid side edge portion 14 with flexible element securing means 16 in the form of eyelets adjacent the front and back ends thereof as in the embodiment previously described; it differs therefrom in that it has no elongated suspending member 20. Because of this, rope 18 is shown simply as being doubled upon itself to form two lengths extending between the eyelets 16 adjacent the ends of each member 14 with knots 30 and 32 formed in the end portions thereof after passage through the second eyelet.

In place of elongated suspending member 20 the seat 38 is provided with a pair of independent hooking elements 24 on each side thereof, each carrying a flexible element securing means 22 adapted to convert the hooking element to a clamp for clamping directly to the gunwale 36 and eliminating the need for an elongated suspension member, the hooking elements 24 themselves comprising the suspending means. This adaptation is shown clearly in FIG. 9 wherein eyelets 22 comprising the securing means for flexible element 18 have their threaded shanks 40 extending through an opening in leg 27 of hooking element 24 provided with clamping plates 42 attached to their free ends to clamp the canoe gunwale 36 between outer legs 28 and inner legs 27 of hooking elements 24. Nuts 43 and 44 threaded onto each shank 40 on opposite sides of leg 27 serve to fix the hooking elements 24 in clamped position on the gunwale 36.

To attach the seat 38 to the gunwales 36 of the canoe hooking elements 24 may be secured to each side of the seating member 12 by threading one length of the rope 18 through the eyelet 22 of one of the hooking elements 24 and the other length of rope 18 through the eyelet 22 of the other hooking element 24, then attaching the hooking elements to the gunwales 36 as shown by moving the rope lengths upward in the directions shown by arrows 46 and 48, the rope 18 then forming the parallel legs 18*a* and 18*b* and crossing diagonal legs 18*c* and 18*d* as shown in dotted outline. Or, the hooking elements 24 may be first attached to the gunwales 36 and the ropes 18 thereafter threaded through eyelets 22 and thence through the eyelet 16 on member 40 through which the end portions of each rope 18 passes. The ropes are knotted as at 30 and 32 to adjust the thus suspended seat.

It is also possible to attach the seat 38 between trees, or other kinds of supports by utilizing eyelet headed wood screws (not shown) or the like as both the suspending means and the flexible element securing means. Further, as in seat 10 if swaying is not a problem the diagonal legs 18*c* and 18*d* of each of the ropes 18 may be eliminated and the rope end portions may be passed through different securing means 16 or 22 and knotted thereagainst or otherwise fixed against slipping back through the securing means. Other similar modifications of my invention will be apparent to those skilled in the art.

What is claimed as new is as follows:

1. A portable seat for suspension between a pair of spaced supports comprising a seating member and suspension members at each side of said seating member, a flexible element interconnecting each of said suspension members to one side of said seating member, said seating member having rigid side edge portions, flexible element securing means adjacent the ends of each rigid side edge portion, each said suspension member comprising an elongated rigid member disposed generally parallel to each side edge portion of said seating member and having flexible element securing means generally opposite those of each said side edge portion, each of said flexible elements being slidably secured to the securing means of each side edge portion and each said suspension member and suspending said seating member therebetween, said flexible elements including adjusting means to adjust the lengths of said flexible elements and thereby adjust the maximum distance between each said side edge portion and each said suspension member of said seat, said flexible elements having parallel legs for interconnecting the securing means of said suspension members and rigid side edge portions and having diagonally crossing legs extending between the diagonally opposite securing means of said suspension members and rigid side edge portions.

2. The portable seat of claim 1 wherein the end portions of each said flexible element pass through a common securing means and said adjusting means prevents reverse passage of said end portions through said securing means.

3. The portable seat of claim 1 wherein said flexible elements comprise ropes of slippery surfaced polymer fibers.

4. The portable seat of claim 1 wherein said suspension members have hooking elements adjacent the ends thereof for hooking over the gunwales of a canoe.

5. A portable seat for suspension between spaced supports comprising a seating member having elongated rigid side edge portions, suspension means associated with and spaced outwardly from each said side edge portion, and a flexible element interconnecting each said suspension means with its associated side edge portion, each said rigid side edge portion having securing means on each end portion thereof and each said suspension means including securing means longitudinally spaced from one another, each said suspension means securing means having an element secured thereto for suspending the seat from a support, each said attached element being generally opposite the securing means of the associated side edge portion, said flexible element interconnecting each side edge portion and its associated suspension means being slidably threaded through each said securing means of each said side edge portion and its associated suspension means for varying the distance between said side edge portion and its associated suspension means, and adjustable means engaging the end portions of said flexible elements to limit reverse passage of said flexible elements through said securing means and thereby adjustably fix the distance between each side edge portion and its associated suspension.

6. The seat of claim 5 wherein said flexible elements are threaded through said securing means to provide diagonal legs extending between diagonally opposite securing means at each side of said seat.

7. The seat of claim 5 wherein said flexible elements are threaded through said securing means to provide generally parallel legs extending between the end portions of each side edge portion and its associated suspension means.

8. The seat of claim 5 wherein said flexible elements are threaded through said securing means to provide generally parallel legs interconnecting said generally opposite securing means and diagonal legs interconnecting the diagonally opposite securing means of said suspension means and their associated side edge portions.

9. The seat of claim 8 wherein the end portions of said flexible elements pass through a common securing means.

10. A portable seat for adjustable suspension between spaced supports comprising a flexible seating member having rigid side edge members and rigid suspension members spaced outwardly from and generally parallel to said side edge members, securing means at each end portion of said side edge members and at each end portion of said suspension members, an elongated flexible element slidably threaded through the securing means of each side edge member and its associated suspension member at each side of said portable seat, said flexible elements being threaded through said securing means and having generally parallel legs extending between the end portions of said side edge members and their associated suspension members, and means adjustably engaging the end portions of each flexible element to adjust the distance between each side edge member and its associated suspension member.

11. The seat of claim 10 wherein said flexible elements include diagonal legs between diagonally opposite securing means.

12. The seat of claim 11 wherein the end portions of each flexible element extend through a common securing means.

13. A portable seat for adjustable suspension between spaced supports comprising a flexible seating member having rigid side edge members and rigid suspension members spaced outwardly from and generally parallel to said side edge members, securing means at each end portion of said side edge members and at each end portion of said suspension members, an elongated flexible element slidably threaded through the securing means of each side edge member and its associated suspension member at each side of said portable seat, said flexible elements being threaded through said securing means and having generally parallel legs extending between the end portions of said side edge members and their associated suspension members and crossing diagonal legs extending between the diagonally opposite securing means of said side edge members and their associated suspension members, and means engaging the end portions of each flexible element to adjust the distance between each side edge member and its associated suspension member.

14. The seat of claim 13 wherein the end portions of each flexible element extend through a common securing means.

* * * * *